US007992221B2

(12) United States Patent
Sonner

(10) Patent No.: US 7,992,221 B2
(45) Date of Patent: Aug. 9, 2011

(54) BALLISTIC COMBAT UNIFORM

(76) Inventor: Matthew Aaron Sonner, Fayetteville, NC (US)

( * ) Notice: Subject to any disclaimer, the term of this patent is extended or adjusted under 35 U.S.C. 154(b) by 1097 days.

(21) Appl. No.: 11/031,145

(22) Filed: Jan. 7, 2005

(65) Prior Publication Data

US 2010/0000001 A1 Jan. 7, 2010

Related U.S. Application Data

(60) Provisional application No. 60/535,656, filed on Jan. 12, 2004.

(51) Int. Cl.
*A41D 13/00* (2006.01)

(52) U.S. Cl. ..... 2/69

(58) Field of Classification Search ..... 2/455, 456, 2/459, 461, 463, 464–468, 16, 23, 24, 268, 2/69, 90, 311, 79, 114, 115, 247, 250
See application file for complete search history.

(56) References Cited

U.S. PATENT DOCUMENTS

| | | | | |
|---|---|---|---|---|
| 3,634,889 | A | 1/1972 | Rolsten | |
| 3,843,969 | A | 10/1974 | George | |
| 3,921,224 | A * | 11/1975 | Ingram, III | 2/93 |
| 4,266,297 | A | 5/1981 | Atkins | |
| 4,384,369 | A | 5/1983 | Prince | |
| 4,485,491 | A | 12/1984 | Rasmussen | |
| 4,507,802 | A | 4/1985 | Small | |
| 4,608,716 | A * | 9/1986 | Brumfield | 2/2.5 |
| 5,044,011 | A | 9/1991 | Henderson | |
| 5,052,052 | A * | 10/1991 | Gilford et al. | 2/467 |
| 5,060,314 | A | 10/1991 | Lewis | |
| 5,157,792 | A | 10/1992 | Allen | |
| 5,398,340 | A | 3/1995 | Kibbee | |
| 5,642,526 | A * | 7/1997 | Thompson | 2/79 |
| 5,729,832 | A | 3/1998 | Grilliot | |
| 5,754,982 | A * | 5/1998 | Gainer | 2/2.5 |
| 5,845,336 | A * | 12/1998 | Golde | 2/93 |
| 5,974,585 | A * | 11/1999 | Bachner, Jr. | 2/2.5 |
| 6,029,270 | A | 2/2000 | Ost | |
| 6,034,004 | A | 3/2000 | Fels | |
| 6,108,813 | A | 8/2000 | Tolliver | |
| 6,260,196 | B1 | 7/2001 | van der Sleesen | |
| 6,263,509 | B1 | 7/2001 | Bowen | |
| 6,339,845 | B1 * | 1/2002 | Burns et al. | 2/243.1 |
| 6,453,791 | B1 * | 9/2002 | Seitzinger | 89/36.05 |
| 6,651,543 | B2 | 11/2003 | Park | |
| 6,656,570 | B1 | 12/2003 | Fels | |
| 6,745,400 | B1 * | 6/2004 | Paciorkowski | 2/69 |
| 6,961,958 | B1 * | 11/2005 | Seitzinger | 2/2.5 |

FOREIGN PATENT DOCUMENTS

| | | | |
|---|---|---|---|
| FR | 002699265 | A1 | 6/1994 |
| GB | 2199233 | A | 7/1988 |

OTHER PUBLICATIONS

US Army Program Executive Office Soldier, The Army Combat Uniform, https://peosoldier.army.mil, Jun. 14, 2004, 2 pages, USA.

* cited by examiner

*Primary Examiner* — Tejash Patel
(74) *Attorney, Agent, or Firm* — Coats & Bennett, P.L.L.C.

(57) ABSTRACT

An improved uniform for military, police, and security personnel that when worn with ballistic vests, offer the wearer increased protection, performance and survivability from low and high velocity projectiles in a combat or tactical environment.

19 Claims, 8 Drawing Sheets

BALLISTIC COMBAT UNIFORM

CROSS-REFERENCE TO RELATED APPLICATIONS

This application claims the benefit of PPA APPL No. 60/535,656, FILING DATE Jan. 12, 2004 by the present inventor.

FEDERALLY SPONSORED RESEARCH

Not Applicable

SEQUENCE LISTING OR PROGRAM

Not Applicable

BACKGROUND OF INVENTION

1. Field of Invention

This invention relates generally to protective garments and more specifically to an adaptive ballistic and blunt force trauma resistant garment that is to be worn in conjunction with ballistic vests.

Due to ballistic vests personnel have been surviving wounds to the torso at a much greater rate than in previous wars. Because of this, most of the wounds and injuries are being sustained in the unprotected arms, lower torso, and legs as the current issue military and law enforcement uniforms are made out of non-ballistic material such as cotton, Nylon, or Nomex.

The US Army is planning to issue the Advanced Combat Uniform (ACU) in FY 2005. It consists of a coat and trousers made of non-ballistic material and are worn with a ballistic vest in a combat environment. It will have cloth receptacles in the elbow and knee areas of the garment to accept foam padding to reduce injury from blunt force trauma. This uniform is similar to previous versions as it provides no protection from low and high velocity projectiles and fragments caused by such weapons as roadside bombs, rocket propelled grenades, mortars and rockets. Because of the serious design shortcomings of the ACU, personnel will continue to suffer needless wounds, injuries and death.

My invention will correct the deficiencies of the ACU and provide personnel with a uniform that will help save their lives. I wore my invention while serving in Iraq in 2004 and it proved to be a valid concept. Depending on the protection level desired, and the size and type of ballistic and non-ballistic panels that are worn, this garment will add no more than 15 pounds to the weight of the equipment carried by the wearer.

U.S. Pat. No. 5,044,011 teaches the use of continuous soft panels of energy absorbent protective material to surround selected body areas. In order to protect the hinged areas of the body, such as elbows and knees, the panels protecting the non-hinged areas must also be worn. This design is not practical to be worn by personnel for extended periods of time, as it is too cumbersome and heavy as it weighs 25 to 30 pounds. It is also not suitable to be worn as a uniform by personnel in a non-lethal environment.

U.S. Pat. No. 6,651,543 teaches the use of a lightweight flak vest. The vest provides no ballistic protection for the upper arms, elbows, lower back, hips and legs.

U.S. Pat. No. 5,060,314 teaches the use of a soft body armor jacket that only protects the neck, upper torso, shoulders, upper arms, and groin of the wearer. The jacket provides no ballistic protection for the elbows, lower back, hips and legs.

U.S. Pat. No. 5,398,340 teaches the use of a bullet resistant vest that is worn under the wearer's uniform. The vest provides no ballistic protection to the upper arms, elbows, lower back, hips, and legs.

U.S. Pat. No. 6,029,270 teaches the use of a modular, all season multi-compartment jacket with bullet-proof features with a mesh panel in the rear. It is designed to be a stand alone garment and not to be worn with tactical ballistic vests in a combat environment. This invention does not provide any form of protection for the legs as is does not include a lower body unit such as trousers or pants.

U.S. Pat. No. 4,507,802 teaches the use of an adaptive ballistic panel carrying garment that has a pocket-like receptacle in both the front and back to receive a ballistic panel. This garment provides no ballistic protection for the upper arms, elbows, lower back, hips and legs.

U.S. Pat. No. 6,651,543 teaches the use of a lightweight soft body-armor product that incorporates ballistic material into a vest that protects the torso. This garment provides no ballistic protection for the upper arms, elbows, lower back, hips and legs.

None of the prior art discussed above combine ballistic and non-ballistic energy absorbent material to protect such areas of the body as the elbows, knees and shins. They are also not suitable to be worn as a uniform for everyday wear.

2. Objects and Advantages

Accordingly, besides the objects and advantages of the protective garment as described in my above patent, several objects and advantages of the present invention are:

(a) to provide a garment for military, police, and security personnel that provides a means for increased protection, survivability, combat confidence and performance;

(b) to provide a garment that is designed to be worn with ballistic vests;

(c) to provide a garment that will increase the comfort of the wearer of a ballistic vest;

(d) to provide a garment that will reduce wounds, injuries and death from low and high velocity projectiles and fragments. The garment includes a plurality of ballistic resistant panels that protect areas of the body that are not covered by ballistic vests;

(e) to provide a garment that is both lightweight and practical enough to be worn for long periods of time in both hot and cold environments;

(f) to provide a garment that can also be worn by personnel when operating in a non-lethal environment such as the police station or military barracks;

(g) to provide a garment that will reduce impact, abrasion and blunt force injuries by combining ballistic and non-ballistic energy absorbing panels where desired;

(h) to provide a garment that will make separate elbow, knee and shin pads obsolete by combining both ballistic and non-ballistic material to protect selected areas of the body.

Further Objects and Advantages of my invention will become apparent from a consideration of the drawings and ensuing description.

SUMMARY

In accordance with the present invention a protective garment comprising of ballistic and non-ballistic energy absorption panels and mesh ventilation panels that is designed to be worn with and compliment the protection afforded the wearer of a ballistic vest.

BRIEF DESCRIPTION OF THE DRAWINGS

Some of the objects of the invention have been set forth above. Other objects and advantages of the invention will appear as the invention proceeds when taken in conjunction with the following drawings, in which.

DRAWINGS—REFERENCE NUMERALS

Figure 1:
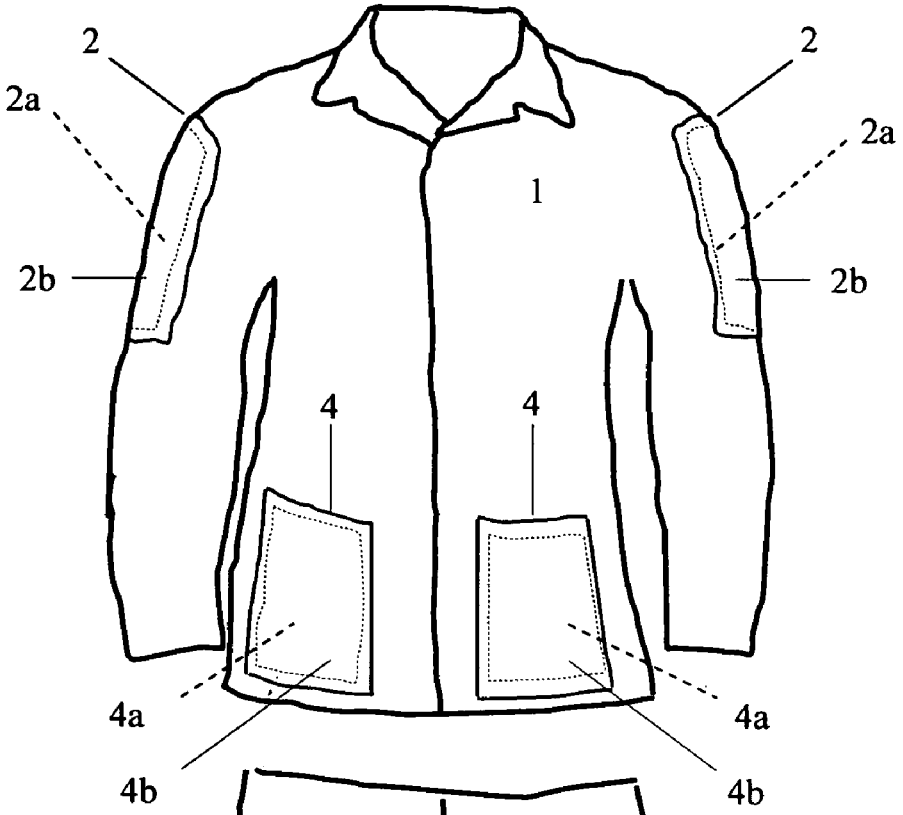
FIG. 1 is a front view of the upper body panel carrier garment according to the principles of the present invention, illustrating one embodiment of the garment in an unworn condition.

1 upper body panel carrier garment
2 upper receptacle openings
2*a* ballistic panels
2*b* upper arm receptacles
3 side mesh ventilation panels
4 lower abdomen receptacle openings
4*a* ballistic panels
4*b* lower abdomen receptacles
5 lower body panel carrier garment
6 thigh receptacle openings
6*a* ballistic panels
6*b* thigh receptacles
7 knee receptacle openings
7*a* ballistic panels
7*b* knee receptacles
7*c* non-ballistic energy absorption panels
8 shin receptacle openings
8*a* ballistic panels
8*b* shin receptacles
8*c* non-ballistic energy absorption panels
9 elbow receptacle openings
9*a* ballistic panels
9*b* elbow receptacles
9*c* non-ballistic energy absorption panels
10 lower back receptacle opening
10*a* ballistic panel
10*b* lower receptacle
11 back mesh ventilation panel
12 hip receptacle openings
12*a* ballistic panel
12*b* hip receptacles
13 ballistic vest

DETAILED DESCRIPTION OF THE INVENTION

Referring now to the drawings and, in particular, to FIG. 1, there is shown a ballistic resistant and energy absorption upper body panel carrier garment of the present invention identified by the numeral 1. In general, carrier garment 1 is designed to closely resemble a standard military or law enforcement tactical uniform coat. However, it will be understood that any shirt or coat-like garment that is worn underneath ballistic vests may be adapted to include the carrier features of the present invention.

Figure 2:
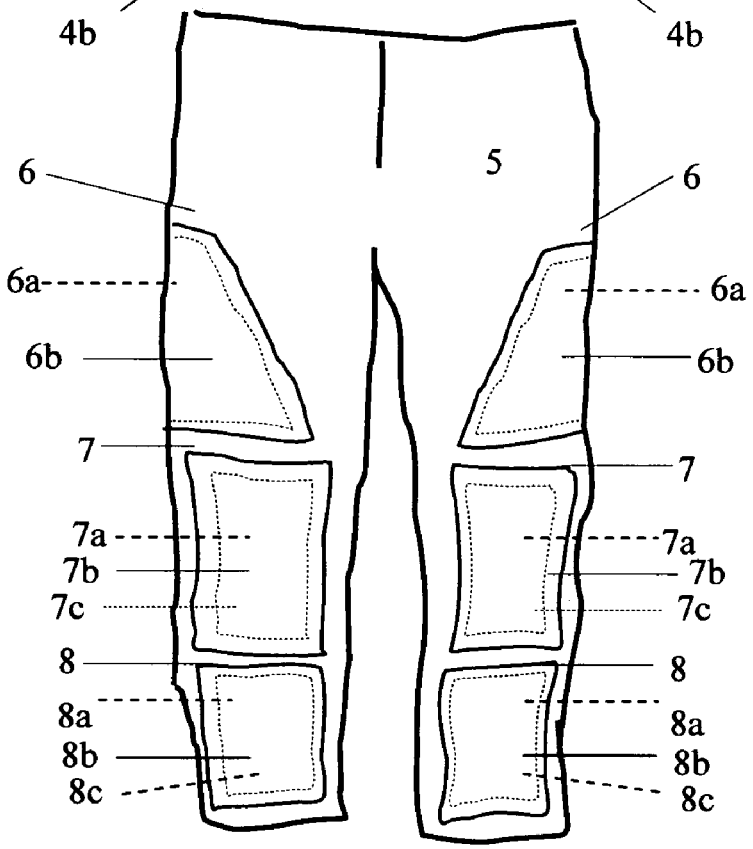
FIG. 2 is a front view of the lower body panel carrier garment according to the principles of the present invention, illustrating one embodiment of the uniform in an unworn condition.

FIG. 2 shows a ballistic resistant and energy absorption lower body panel carrier garment of the present invention identified by the numeral 5. In general, carrier garment 5 is designed to closely resemble standard military or law enforcement tactical uniform trousers. However, it will be understood that any trousers or pant-like garment may be adapted to include the carrier features of the present invention.

The level of protection is provided by a plurality of ballistic resistant panels and is predetermined by the agency or wearer and is based on the US National Institute of Justice guidelines and Certification tests for different ballistic material. They range from Threat levels I through IIIA. Level I material will protect the wearer from bullets and fragments with a velocity and weight comparable to a .38 cal pistol round weighing 158 grains and moving at 850 feet per second. Level IIIA material will protect the wearer from bullets and fragments with a velocity and weight comparable to a .44 Magnum pistol round weighing 240 grains and moving at 1,400 feet per second.

Both the panel carrier garment coat and trousers may be fabricated of any natural or synthetic material. A plurality of cargo pockets with flap closures covers both the upper and lower panel carrier garment that allow the wearer to store personnel items and mission equipment.

As shown in FIGS. 1, 3, 5 and 7 the upper body panel carrier garment is accommodated to have cloth-like receptacles 2*b* formed on the outer layer of fabric that each contain an opening 2 on the upper edge. A ballistic panel 2*a* is inserted and removed through openings 2 and into receptacles 2*b* to provide protection to the outer portion of the upper arms.

As shown in FIG. 1 the upper body panel carrier garment is accommodated to have cloth-like receptacles 4*b* formed on the outer layer of fabric that each contain an opening 4 on the upper edge. A ballistic panel 4*a* is inserted and removed through openings 4 and into receptacles 4*b* to provide protection to the front of the abdomen that is not covered by a ballistic vest. Said ballistic panels will also protect the femoral artery and will reduce death from rapid blood loss.

Figure 6:
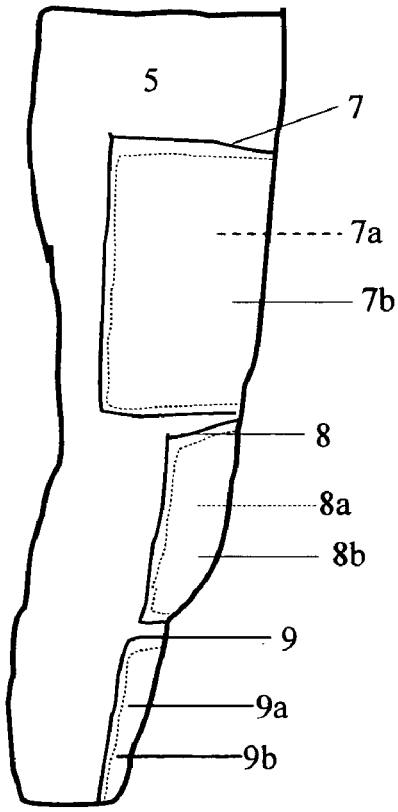
FIG. 6 is a right side view of a lower body panel carrier garment according to the principles of the present invention, illustrating one embodiment of the uniform in an unworn condition.
Figure 8:
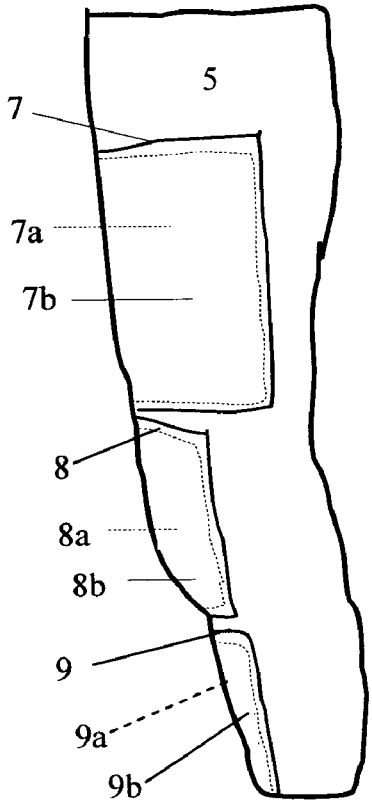
FIG. 8 is a left side view of a lower body panel carrier garment according to the principles of the present invention, illustrating one embodiment of the uniform in an unworn condition.
Figure 9:
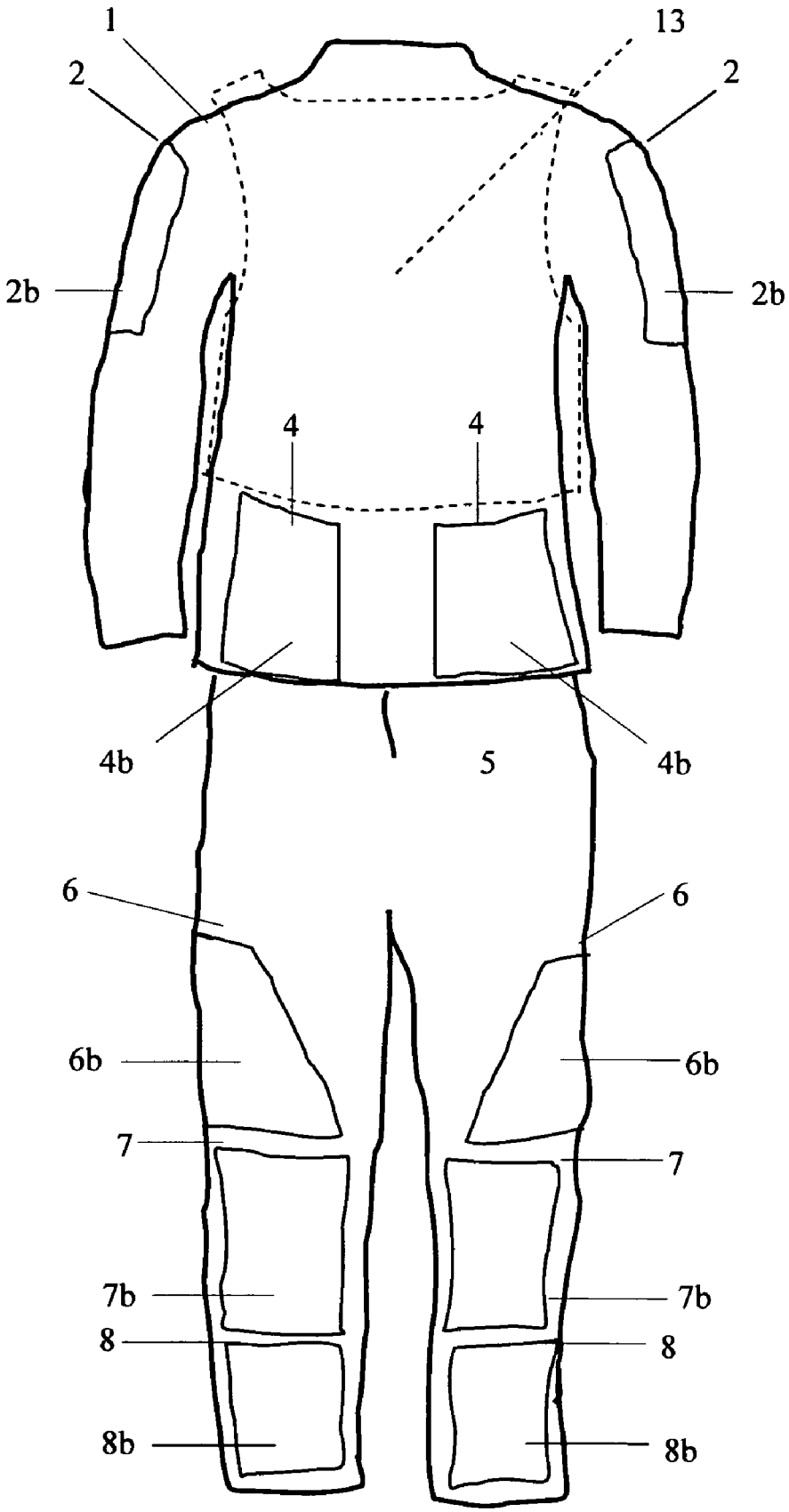
FIG. 9 is a front view of the panel carrier garment according to the principles of the present invention with a ballistic vest, illustrating one embodiment of the uniform in a worn condition.
Figure 10:
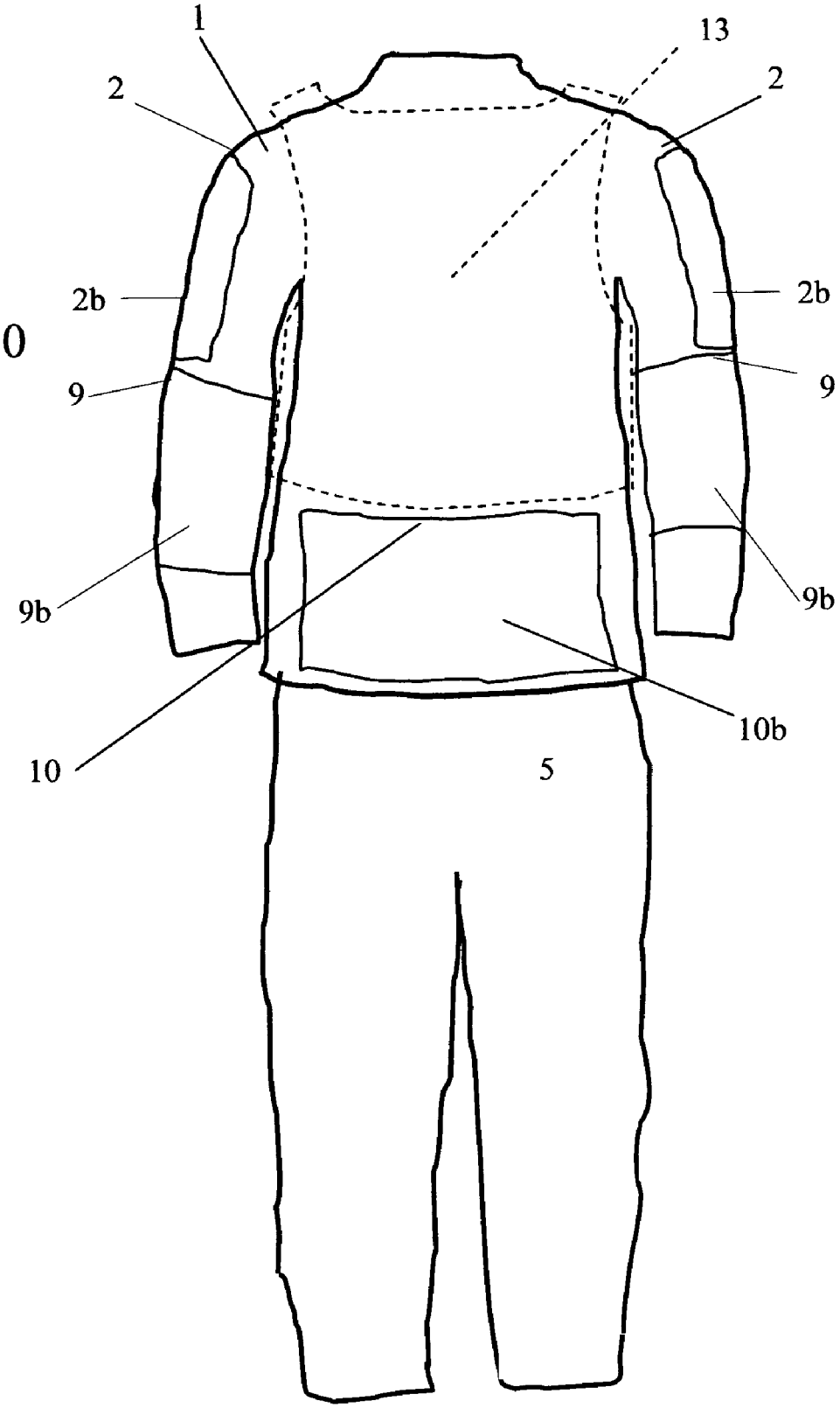
FIG. 10 is a rear view of the panel carrier garment according to the principles of the present invention with a ballistic vest, illustrating one embodiment of the uniform in a worn condition.
Figure 11:
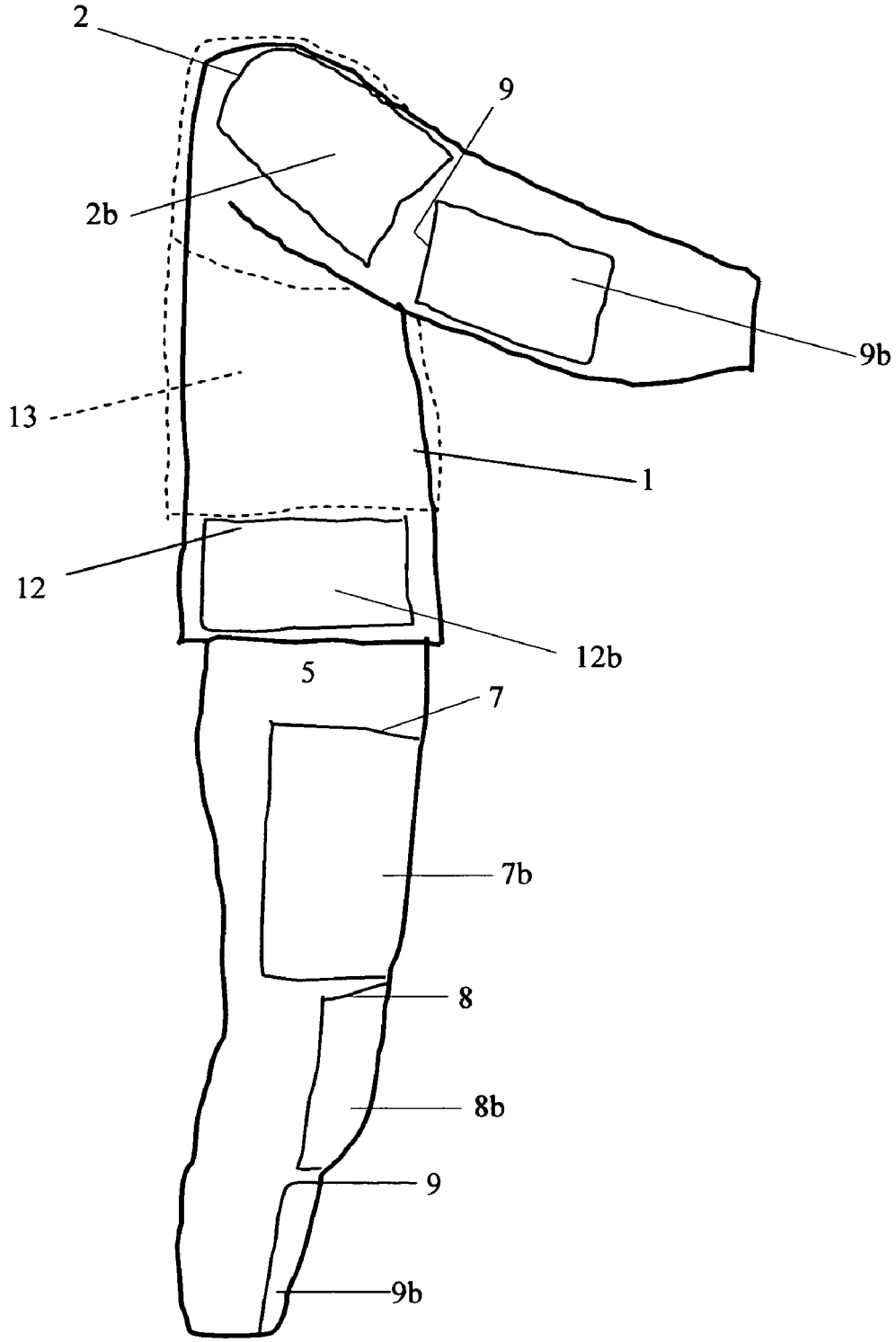
FIG. 11 is a right side view of the panel carrier garment according to the principles of the present invention with a ballistic vest, illustrating one embodiment of the uniform in a worn condition.
Figure 12:
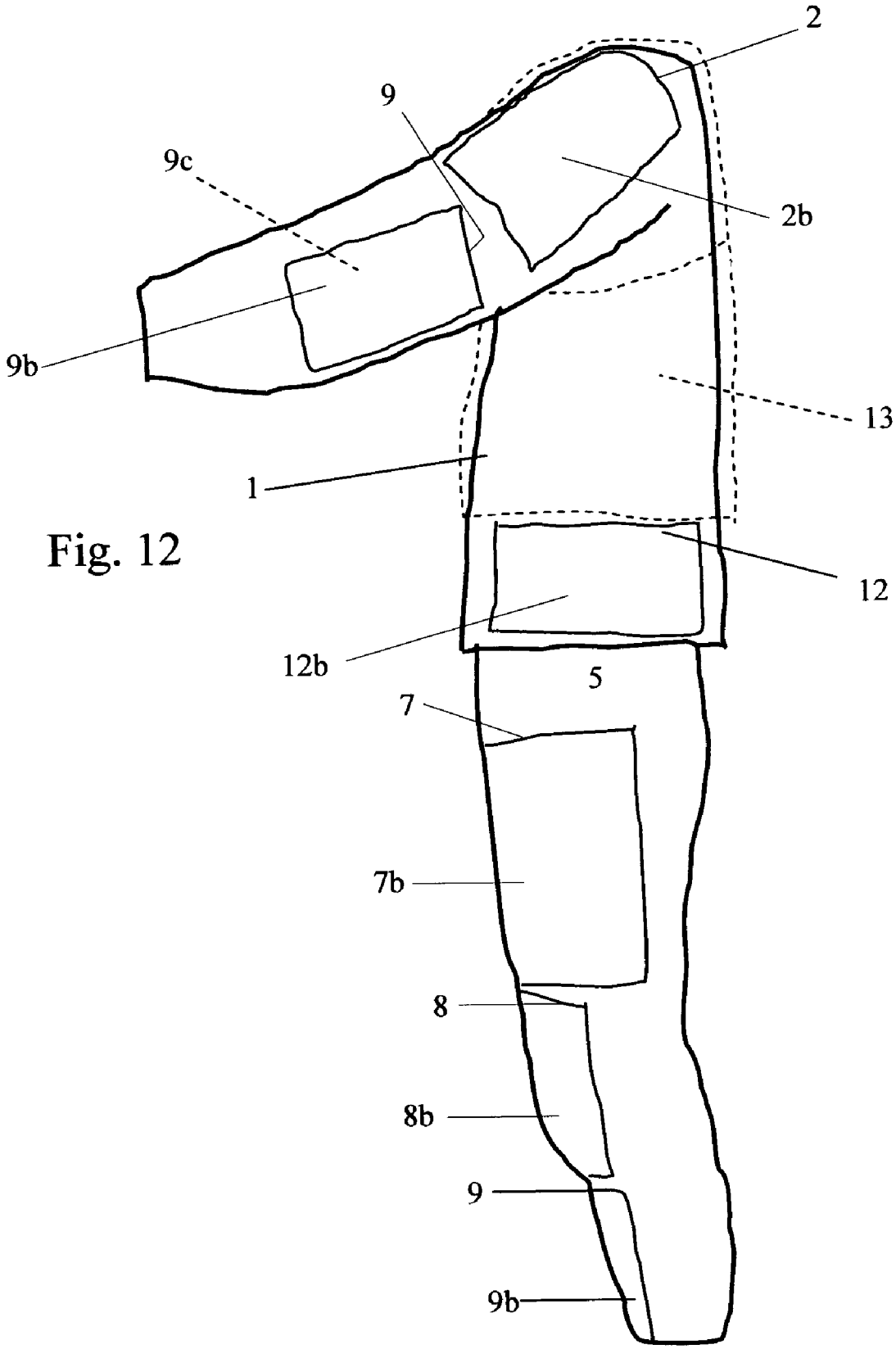
FIG. 12 is a left side view of the panel carrier garment according to the principles of the present invention with a ballistic vest, illustrating one embodiment of the uniform in a worn condition.

As shown in FIGS. 2, 6 and 8 the lower body panel carrier garment is accommodated to have cloth-like receptacles 6*b* formed on the outer layer of fabric that each contain an opening 6 on the upper edge. A ballistic panel 6*a* is inserted and removed through openings 6 and into receptacles 6*b* to provide protection to the thighs.

As shown in FIGS. 2, 6 and 8 the lower body panel carrier garment is accommodated to have cloth-like receptacles 7*b* formed on the outer layer of fabric that each contain an opening 7 on the upper edge. A ballistic panel 7*a* is inserted and removed through openings 7 and into receptacles 7*b* to provide protection to the frontal portion of the knees. A non-ballistic energy absorption panel 7*c* is inserted and removed through openings 7 and into receptacles 7*b* behind ballistic panels 7*a* to provide increased blunt force trauma protection to the knees.

As shown in FIGS. 2, 6 and 8 the lower body panel carrier garment is accommodated to have cloth-like receptacles 8*b* formed on the outer layer of fabric that each contain an opening 8 on the upper edge. A ballistic panel 8*a* is inserted and removed through openings 8 and into receptacles 8*b* to provide protection to the frontal portion of the knees. A non-ballistic energy absorption panel 8*c* is inserted and removed through openings 8 and into receptacles 8*b* behind ballistic panels 8*a* to provide increased blunt force trauma protection to the shins.

Figure 3:
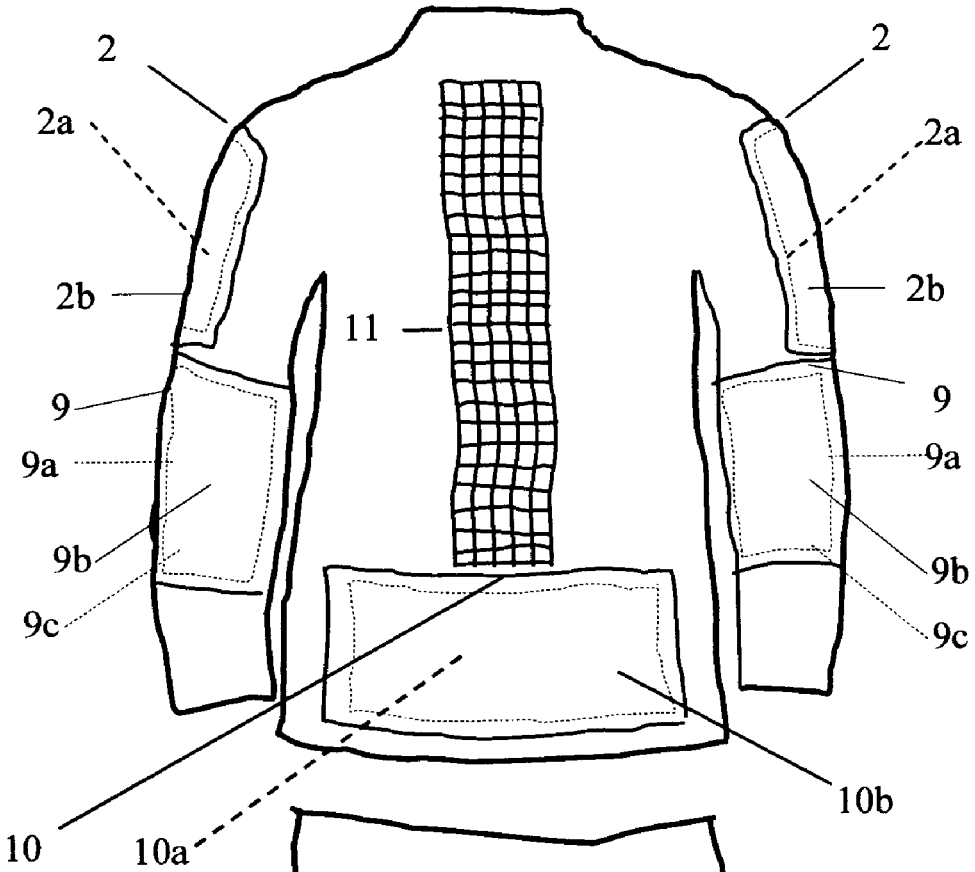
FIG. 3 is a rear view of the upper body panel carrier garment according to the principles of the present invention, illustrating one embodiment of the garment in an unworn condition.
Figure 5:
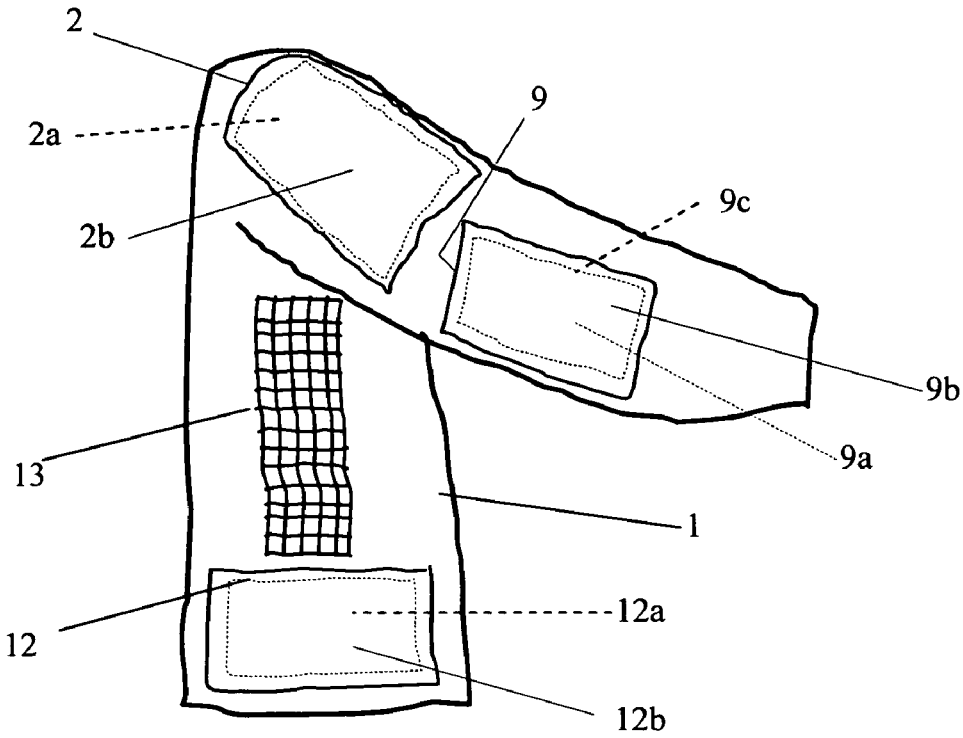
FIG. 5 is a right side view of the upper body panel carrier garment according to the principles of the present invention, illustrating one embodiment of the garment in an unworn condition.
Figure 7:
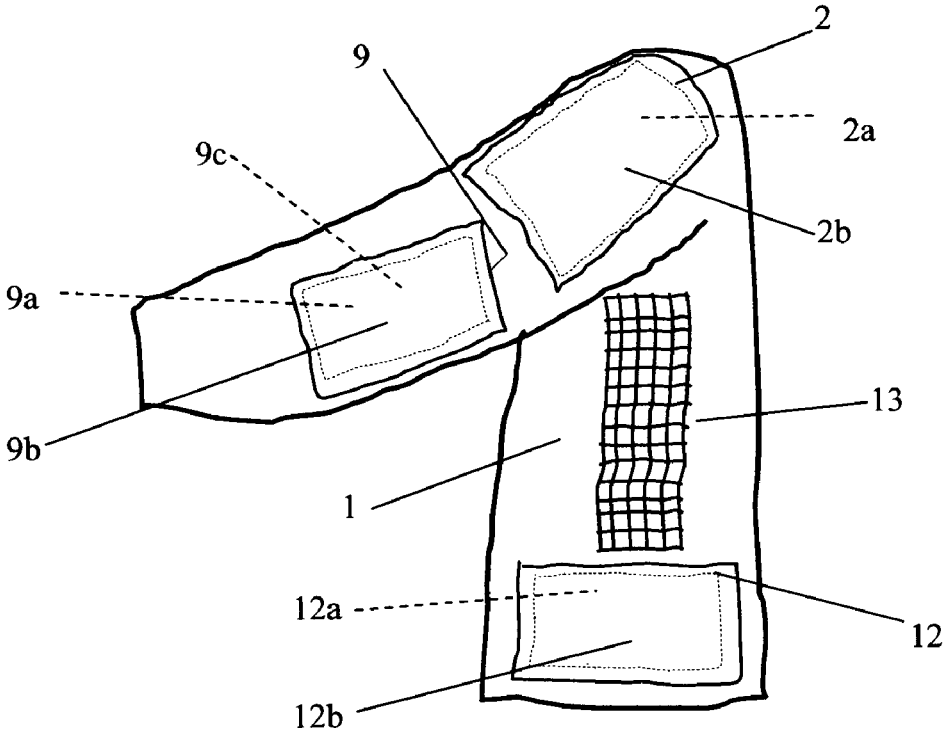
FIG. 7 is a left side view of the upper body panel carrier garment according to the principles of the present invention, illustrating one embodiment of the garment in an unworn condition.

As shown in FIGS. 3, 5 and 7 the upper body panel carrier garment is accommodated to have cloth-like receptacles 9*b* formed on the outer layer of fabric that each contain an opening 9 on the upper edge. A ballistic panel 9*a* is inserted and removed through openings 9 and into receptacles 9*b* to provide protection to the outer portion of the elbows. A non-ballistic energy absorption panel 9*c* is inserted and removed through openings 9 and into receptacles 9*b* behind ballistic panels 9*a* to provide increased blunt force trauma protection to the elbows.

As shown in FIG. 3 the upper body panel carrier garment is accommodated to have cloth-like receptacle 10*b* formed on the outer layer of fabric that contain an opening 10 on the upper edge. A ballistic panel 10*a* is inserted and removed through opening 10 and into receptacle 10*b* to provide protection to the portion of the lower back that is not covered by a ballistic vest.

As shown in FIG. 3 the upper body panel carrier garment is accommodated to have a mesh ventilation panel 11 fabricated on the back. The mesh panel 11 will keep the wearer more comfortable while wearing a ballistic vest as it will enable body heat and moisture to escape from underneath.

Figure 4:
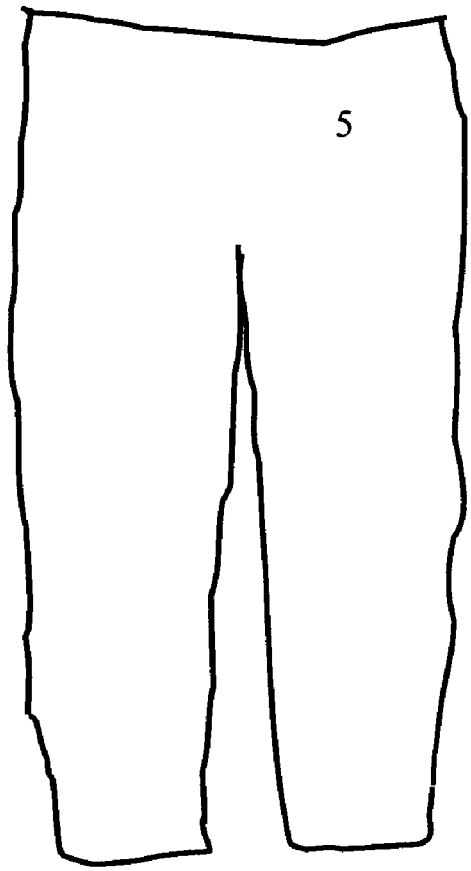
FIG. 4 is a rear view of a lower body panel carrier garment according to the principles of the present invention, illustrating one embodiment of the uniform in an unworn condition.

As shown in FIG. 4 the rear of the lower body garment 7 does not have any cloth-like receptacles for the insertion and removal of ballistic and non-ballistic energy absorption panels. This is to keep the overall weight of the garment to a minimum, to enable the wearer to stay cooler and more comfortable and to enable the wearer to move faster for longer periods of time. The design of the lower body garment also recognizes that many threats from injury by both low and high velocity fragments and projectiles come from in front of the wearer during a tactical situation.

The invention claimed is:

1. A protective uniform for use by a person in combat or law enforcement, said uniform comprising:

a. an upper body garment and a separate lower body garment b. a plurality of a ballistic and non-ballistic panels for attaching to the upper body garment and the lower body garment, and;

c. a plurality of attaching and supporting structures disposed on selected areas of the upper body garment and the lower body garment for detachably receiving and holding the plurality of ballistic panels and the plurality of non-ballistic panels.

2. The protective uniform of claim 1 wherein the plurality of attaching and supporting structures comprises a plurality of pockets, each pocket including an opening for receiving a ballistic panel.

3. The protective uniform of claim 2 with each of the plurality of ballistic panels being constructed to provide at least threat level I protection wherein threat level 1 protection will protect a wearer from bullets and fragments with a velocity and weight comparable to a .38 caliber pistol round weighing 158 grains and moving at 850 feet per second.

4. The protective uniform of claim 3 wherein at least one of the pockets is disposed on the upper body garment adjacent an area selected from a group including an upper arm area, an elbow area, a lower abdominal area, a hip area, and a lower back area.

5. The protective uniform of claim 3 wherein at least one of the pockets is disposed on the lower body garment adjacent an area selected from a group including a thigh area, a knee area, and a shin area.

6. The protective uniform of claim 1 including a ballistic vest.

7. The protective uniform of claim 1 wherein at least one of the upper body garment and lower body garment includes an opening with overlapping front peripheral edges.

8. The protective uniform of claim 1 wherein a part of the upper body garment is adapted such that it overlies a part of the lower body garment.

9. The protective uniform of claim 1 wherein one or more ventilation panels are disposed on selected areas of the of the upper body garment and the lower body garment.

10. The protective uniform of claim 1 including a mesh ventilation panel in a side portion of the upper body garment or the lower body garment.

11. The protective uniform of claim 1 including a mesh ventilation panel in a center back portion of the upper body garment.

12. A protective uniform for providing ballistic protection for a person, the uniform comprising:

a. a garment;

b. a plurality of ballistic panels detachably supported by the garment and disposed on the garment so as to overlie selected parts of the person;

c. each of the plurality of ballistic panels being constructed to provide at least threat level I protection wherein threat level 1 protection will protect a wearer from bullets and fragments with a velocity and weight comparable to a .38 caliber pistol round weighing 158 grains and moving at 850 feet per second;

d. one or more attaching and supporting structures for detachably supporting the ballistic panels on the garment; and e. a plurality of non-ballistic panels, each non-ballistic panel detachably supported on the garment by the attaching and supporting structures so as to overlie a selected part of the person.

13. The protective uniform of claim 12 wherein the attaching and supporting structures include a plurality of pockets, each pocket having an opening adapted to receive a panel.

14. The protective uniform of claim 12 wherein the plurality of ballistic panels and the plurality of non-ballistic panels do not exceed 15 pounds in weight.

15. A method of providing ballistic protection to a person, the method comprising:

detachably securing to a uniform worn by the person a plurality of ballistic panels and a plurality of non-ballistic panels adjacent selected parts of the person; and constructing each of the plurality of ballistic panels utilizing a material having at least threat level I protection wherein threat level I protection will protect a wearer from bullets and fragments with a velocity and weight comparable to a .38 caliber pistol round weighing 158 grains and moving at 850 feet per second.

16. The method of claim 15 including detachably securing the non-ballistic panels adjacent one or more ballistic panels.

17. The method of claim 15 including adding no more than 15 pounds due to the ballistic and non-ballistic panels to a weight carried by the person.

18. The protective uniform of claim 1 wherein the plurality of attaching and supporting structures are disposed on an outer portion of the on upper body garment and an outer portion of the lower body garment.

19. The protective uniform of claim 1 wherein when the non-ballistic panels are held in the attaching and supporting structures the non-ballistic panels are disposed behind the ballistic panels.

* * * * *